US010764692B2

(12) United States Patent
Lim et al.

(10) Patent No.: US 10,764,692 B2
(45) Date of Patent: Sep. 1, 2020

(54) PIEZOELECTRIC DEVICE AND DISPLAY APPARATUS INCLUDING THE SAME

(71) Applicant: LG Display Co., Ltd., Seoul (KR)

(72) Inventors: KiSung Lim, Paju-si (KR); Jaekyung Kang, Paju-si (KR); DongRyul Jung, Paju-si (KR); Sujin Chang, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 16/553,687

(22) Filed: Aug. 28, 2019

(65) Prior Publication Data

US 2020/0077200 A1 Mar. 5, 2020

(30) Foreign Application Priority Data

Aug. 30, 2018 (KR) ..... 10-2018-0103021

(51) Int. Cl.
*H04R 17/00* (2006.01)
*H04R 1/02* (2006.01)
*H04R 1/28* (2006.01)

(52) U.S. Cl.
CPC ..... *H04R 17/00* (2013.01); *H04R 1/028* (2013.01); *H04R 1/2888* (2013.01); *H04R 2400/03* (2013.01); *H04R 2499/15* (2013.01)

(58) Field of Classification Search
None
See application file for complete search history.

(56) References Cited

U.S. PATENT DOCUMENTS

| | | | | |
|---|---|---|---|---|
| 8,861,752 | B2 * | 10/2014 | Margalit | H04R 31/00 381/152 |
| 8,994,247 | B2 | 3/2015 | Okamura et al. | |
| 2013/0094681 | A1 * | 4/2013 | Fukuoka | H04R 17/00 381/190 |
| 2014/0203684 | A1 * | 7/2014 | Yamamoto | B06B 1/0603 310/322 |
| 2018/0160209 | A1 * | 6/2018 | Ogata | H04R 1/288 |
| 2018/0164890 | A1 | 6/2018 | Park et al. | |

FOREIGN PATENT DOCUMENTS

| | | | |
|---|---|---|---|
| KR | 10-1601748 | B1 | 3/2016 |
| KR | 10-2017-0133541 | A | 12/2017 |
| KR | 10-2018-0068410 | A | 6/2018 |

* cited by examiner

*Primary Examiner* — James K Mooney
(74) *Attorney, Agent, or Firm* — Morgan, Lewis & Bockius LLP

(57) ABSTRACT

A piezoelectric device and a display apparatus including the same are provided. A piezoelectric device includes: a first piezoelectric unit including a vibration-generating layer configured to vibrate at an input frequency based on a sound signal corresponding to the input frequency, and a second piezoelectric unit including: an air gap in the first piezoelectric unit, the air gap having a certain volume, and an air path connecting the air gap to an outer portion of the vibration-generating layer, the air path being configured to output a vibration.

22 Claims, 9 Drawing Sheets

PIEZOELECTRIC DEVICE AND DISPLAY APPARATUS INCLUDING THE SAME

CROSS-REFERENCE TO RELATED APPLICATION(S)

This application claims the benefit of and priority to Korean Patent Applications No. 10-2018-0103021, filed on Aug. 30, 2018, the entirety of which is hereby incorporated by reference.

BACKGROUND

1. Technical Field

The present disclosure relates to a piezoelectric device and a display apparatus including the same.

2. Discussion of the Related Art

Recently, as the information-oriented society advances, the field of display apparatuses for visually displaying electrical information signals has rapidly advanced. Various display apparatuses having excellent performance features, such as thinness, light weight, and low power consumption, are being developed. Examples of the display apparatuses include liquid crystal display (LCD) apparatuses, field emission display (FED) apparatuses, light-emitting display apparatuses, etc.

Display apparatuses display an image on a display panel, and an additional speaker generally has been installed for providing a sound. If the speaker is installed in the display apparatus, the sound generated in the speaker advances toward a side portion or toward an upper/lower portion of the display panel instead of a front portion or a rear portion of the display panel. Thus, the sound does not advance toward the front portion of the display panel, e.g., toward a user who watches the image displayed on the display panel, so that it disrupts a user's immersion experience. In addition, if the speaker is included in a set apparatus, such as a television (TV), the speaker occupies a space that may impose a restriction on design and a spatial disposition of the set apparatus.

SUMMARY

Accordingly, the present disclosure is directed to a piezoelectric device and a display apparatus including the same that substantially obviate one or more of the issues due to limitations and disadvantages of the related art.

An aspect of the present disclosure is to provide a display apparatus that includes a first piezoelectric unit outputting a sound based on an input frequency and a second piezoelectric unit outputting a sound based on a frequency differing from the input frequency, thereby enhancing a low-pitched sound output characteristic of a piezoelectric device.

Another aspect of the present disclosure is to provide a display apparatus that includes a piezoelectric device including first and second piezoelectric units, outputs a sound of a whole domain of an audible frequency through the first piezoelectric unit, and outputs a sound of a low frequency domain through the second piezoelectric unit.

Another aspect of the present disclosure is to provide a display apparatus that uses a second piezoelectric unit as a dedicated low-pitched sound speaker to enhance a low-pitched sound output characteristic of a piezoelectric device.

Another aspect of the present disclosure is to provide a display apparatus that outputs a sound toward a forward region in front of a display panel to allow an image generating position to match a sound generating position, thereby increasing or maximizing a sense of reality and an immersion experience.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other aspects of the inventive concepts as embodied and broadly described, there is provided a piezoelectric device, including: a first piezoelectric unit including a vibration-generating layer configured to vibrate at an input frequency based on a sound signal corresponding to the input frequency, and a second piezoelectric unit including: an air gap in the first piezoelectric unit, the air gap having a certain volume, and an air path connecting the air gap to an outer portion of the vibration-generating layer, the air path being configured to output a vibration.

In another aspect, there is provided a display apparatus, including: a substrate, a piezoelectric device on the substrate, the piezoelectric device being configured to generate a vibration, the piezoelectric device including: a first piezoelectric unit including a vibration-generating layer configured to vibrate at an input frequency based on a sound signal corresponding to the input frequency, and a second piezoelectric unit including: an air gap in the first piezoelectric unit, the air gap having a certain volume, and an air path connecting the air gap to an outer portion of the vibration-generating layer, the air path being configured to output a vibration, and a pixel array layer including: a thin-film transistor on the piezoelectric device, and a light-emitting device connected to the thin-film transistor.

Other systems, methods, features and advantages will be, or will become, apparent to one with skill in the art upon examination of the following figures and detailed description. It is intended that all such additional systems, methods, features and advantages be included within this description, be within the scope of the present disclosure, and be protected by the following claims. Nothing in this section should be taken as a limitation on those claims. Further aspects and advantages are discussed below in conjunction with embodiments of the disclosure. It is to be understood that both the foregoing general description and the following detailed description of the present disclosure are examples and explanatory, and are intended to provide further explanation of the disclosure as claimed.

BRIEF DESCRIPTION OF THE DRAWINGS

The accompanying drawings, that may be included to provide a further understanding of the disclosure and are incorporated in and constitute a part of this specification, illustrate embodiments of the disclosure and together with the description serve to explain various principles of the disclosure.

Figure 1:
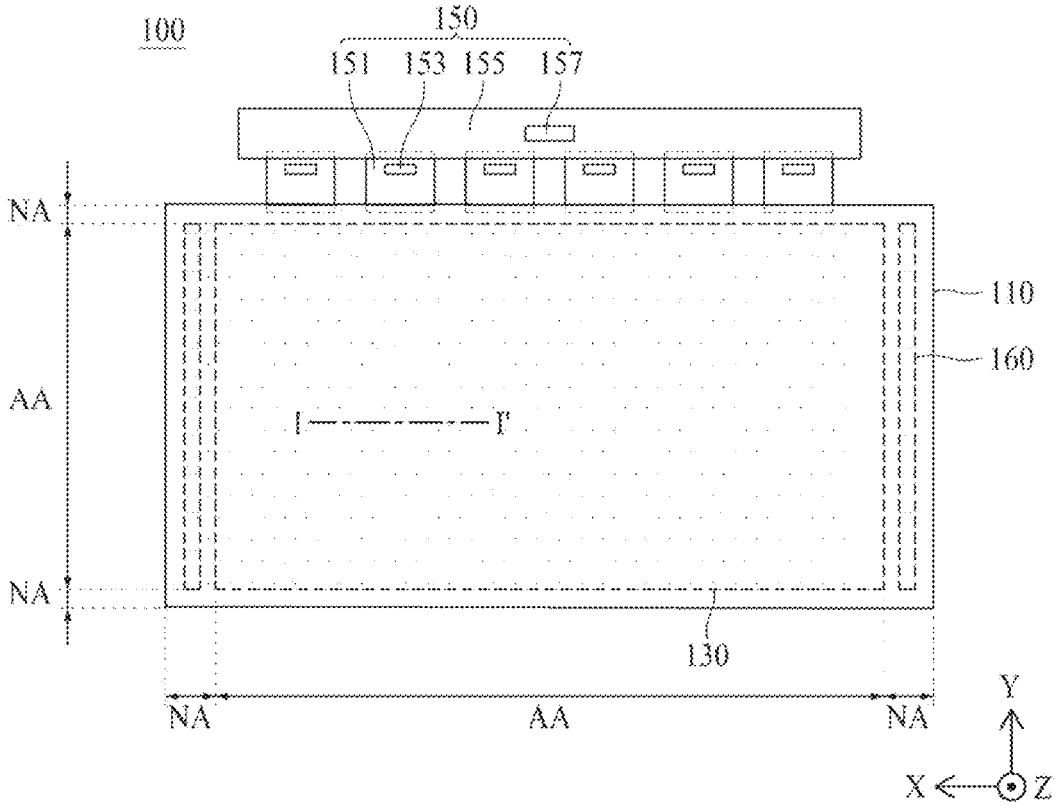
FIG. 1 is a plan view illustrating a display apparatus according to an embodiment of the present disclosure.

Throughout the drawings and the detailed description, unless otherwise described, the same drawing reference numerals should be understood to refer to the same elements, features, and structures. The relative size and depiction of these elements may be exaggerated for clarity, illustration, and convenience.

DETAILED DESCRIPTION

Reference will now be made in detail to embodiments of the present disclosure, examples of which may be illustrated in the accompanying drawings. In the following description, when a detailed description of well-known functions or configurations related to this document is determined to unnecessarily cloud a gist of the inventive concept, the detailed description thereof will be omitted. The progression of processing steps and/or operations described is an example; however, the sequence of steps and/or operations is not limited to that set forth herein and may be changed as is known in the art, with the exception of steps and/or operations necessarily occurring in a particular order. Like reference numerals designate like elements throughout. Names of the respective elements used in the following explanations are selected only for convenience of writing the specification and may be thus different from those used in actual products.

It will be understood that, although the terms "first," "second," etc. may be used herein to describe various elements, these elements should not be limited by these terms. These terms are only used to distinguish one element from another. For example, a first element could be termed a second element, and, similarly, a second element could be termed a first element, without departing from the scope of the present disclosure.

The term "at least one" should be understood as including any and all combinations of one or more of the associated listed items. For example, the meaning of "at least one of a first item, a second item, and a third item" denotes the combination of all items proposed from two or more of the first item, the second item, and the third item as well as the first item, the second item, or the third item.

In the description of embodiments, when a structure is described as being positioned "on or above" or "under or below" another structure, this description should be construed as including a case in which the structures contact each other as well as a case in which a third structure is disposed therebetween. The size and thickness of each element shown in the drawings are given merely for the convenience of description, and embodiments of the present disclosure are not limited thereto.

Features of various embodiments of the present disclosure may be partially or overall coupled to or combined with each other, and may be variously inter-operated with each other and driven technically as those skilled in the art can sufficiently understand. Embodiments of the present disclosure may be carried out independently from each other, or may be carried out together in co-dependent relationship.

In the present disclosure, examples of a display apparatus may include a narrow-sense display apparatus, such as an organic light-emitting display (OLED) module or a liquid crystal module (LCM) including a display panel and a driver for driving the display panel. Also, examples of the display apparatus may include a set device (or a set apparatus) or a set electronic device, such as a notebook computer, a television (TV), a computer monitor, an equipment apparatus including an automotive apparatus or another type apparatuses for vehicles, or a mobile electronic device, such as a smartphone or an electronic pad, which is a complete product (or a final product) including an LCM or an OLED module. Therefore, in the present disclosure, examples of the display apparatus may include a narrow-sense display apparatus itself, such as an LCM or an OLED module, and a set device, which is a final consumer device or an application product including the LCM or the OLED module.

In some embodiments, an LCM or an OLED module including a display panel and a driver may be referred to as a narrow-sense display apparatus, and an electronic device, which is a final product including an LCM or an OLED module, may be referred to as a set device. For example, the narrow-sense display apparatus may include a display panel, such as an LCD or an OLED, and a source printed circuit board (PCB), which is a controller for driving the display panel. The set device may further include a set PCB, which is a set controller electrically connected to the source PCB to overall control the set device.

A display panel applied to the present embodiment may use any type of display panel, such as a liquid crystal display panel, an organic light-emitting diode (OLED) display panel, and an electroluminescent display panel, but is not limited to any specific type of display panel that is vibrated by a sound generation device according to the present embodiment to output a sound. Also, a shape or a size of a display panel applied to a display apparatus according to the present embodiment is not limited.

For example, if the display panel is the liquid crystal display panel, the display panel may include a plurality of gate lines, a plurality of data lines, and a plurality of pixels respectively provided in a plurality of pixel areas defined by intersections of the gate lines and the data lines. Also, the display panel may include an array substrate including a thin-film transistor (TFT) which is a switching element for adjusting a light transmittance of each of the plurality of pixels, an upper substrate including a color filter and/or a black matrix, and a liquid crystal layer between the array substrate and the upper substrate.

Moreover, if the display panel is the organic light-emitting display panel, the display panel may include a plurality of gate lines, a plurality of data lines, and a plurality of pixels respectively provided in a plurality of pixel areas defined by intersections of the gate lines and the data lines. Also, the display panel may include an array substrate including a TFT that is an element for selectively applying a voltage to each of the pixels, an organic light-emitting device layer on the array substrate, and an encapsulation substrate disposed on the array substrate to cover the organic light-emitting device layer. The encapsulation substrate may protect the TFT and the organic light-emitting device layer from an external impact, and may reduce or prevent water or oxygen from penetrating into the organic light-emitting device layer. Also, a layer provided on the array substrate may include an inorganic light-emitting layer (for example, a nano-sized material layer, a quantum dot, or the like). As another example, the layer provided on the array substrate may include a micro light-emitting diode.

The display panel may further include a backing, such as a metal plate attached to the display panel. However, embodiments are not limited to the metal plate, and the display panel may include another structure.

Hereinafter, a piezoelectric device and a display apparatus including the same according to an embodiment of the present disclosure will be described in detail with reference to the accompanying drawings.

FIG. 1 is a plan view illustrating a display apparatus according to an embodiment of the present disclosure.

With reference to FIG. 1, a display apparatus 100 may include a first substrate 110, a pixel array layer 130, a display driving circuit unit 150, and a scan driving circuit unit 160. Hereinafter, an example in which the display apparatus is implemented as an organic light-emitting display apparatus will be mainly described, but the display apparatus may be implemented as an LCD apparatus or an electrophoresis display apparatus, for example. Also, a light-emitting display apparatus may be applied to a bottom-emission display apparatus, a top-emission display apparatus, and a dual-emission display apparatus, but is not limited thereto.

The first substrate 110 may be a base substrate, and may be a flexible substrate. For example, the first substrate 110 may include a transparent polyimide material. Considering that a high temperature deposition process may be performed on the first substrate 110, polyimide, which has good heat resistance and can endure a high temperature, may be used. The first substrate 110 including polyimide may be formed by curing a polyimide resin, which may be coated to have a certain thickness on a front surface of a sacrificial layer provided on a carrier glass substrate. For example, the carrier glass substrate may be separated from the first substrate 110 by releasing the sacrificial layer through a laser release process. Also, the sacrificial layer may include amorphous silicon (a-Si) or silicon nitride ($SiN_x$).

According to an embodiment of the present disclosure, the first substrate 110 may be a glass substrate. For example, the first substrate 110 may include silicon dioxide ($SiO_2$) or aluminum oxide ($Al_2O_3$) as main components.

The first substrate 110 may include a display area AA and a non-display area NA. The display area AA may be an area that may display an image, and may be a center portion of the first substrate 110. For example, the display area AA may correspond to an active area of the pixel array layer 130. For example, the display area AA may include a plurality of pixels P respectively in a plurality of pixel areas defined by intersections of a plurality of gate lines and a plurality of data lines. Alternatively, the display area AA may include the plurality of pixels P provided by the plurality of gate lines and the plurality of data lines. For example, each of the plurality of pixels may be a minimum-unit area that may emit light. The non-display area NA may be an area that may not display an image, and may be defined in an edge or periphery of the first substrate 110 surrounding the display area AA.

The pixel array layer 130 may include a thin-film transistor (TFT) layer and a light-emitting device layer. The TFT layer may include a TFT, a gate insulation layer, an interlayer insulation layer, a passivation layer, and a planarization layer. Also, the light-emitting device may include a plurality of light-emitting devices and a plurality of banks. A detailed configuration of the pixel array layer 130 will be described in detail with reference to FIG. 2.

The display driving circuit unit 150 may be connected to a pad part in the non-display area NA of the first substrate 110, and may allow each pixel to display an image corresponding to video data supplied from a display driving system. According to an embodiment of the present disclosure, the display driving circuit unit 150 may include a plurality of flexible circuit films 151, a plurality of data driving integrated circuits (ICs) 153, a printed circuit board (PCB) 155, and a timing controller 157.

Input terminals on one portion of each of the plurality of flexible circuit films 151 may be attached to the PCB 155 through a film attachment process, and output terminals on the other portion of each of the plurality of flexible circuit films 151 may be attached to the pad part through the film attachment process. According to an embodiment of the present disclosure, each of the plurality of flexible circuit films 151 may be implemented as a flexible circuit film, e.g., for decreasing a bezel area of the display apparatus 100. For example, each of the plurality of flexible circuit films 151 may be configured as a tape carrier package (TCP) or a chip-on-film (or a chip-on-flexible-board) (COF).

Each of the plurality of data driving ICs 153 may be individually mounted on a corresponding flexible circuit film 151. Each of the plurality of data driving ICs 153 may receive pixel data and a data control signal from the timing controller 157, may convert the pixel data into a pixel-based analog data signal according to the data control signal, and may supply the analog data signal to a corresponding data line.

The PCB 155 may support the timing controller 157, and may transfer signals and power between elements of the display driving circuit unit 150. The PCB 155 may provide the plurality of data driving ICs 153 and the scan driving circuit unit 160 with signals and a driving power, each supplied from the timing controller 157, for allowing each pixel to display an image. For example, a signal transfer line and various power lines may be provided on the PCB 155. For example, the PCB 155 may be provided as one or as a plurality, e.g., based on the number of flexible circuit films 151.

The timing controller 157 may be mounted on the PCB 155, and may receive the video data and a timing synchronization signal from the display driving system, e.g., through a user connector on the PCB 155. The timing controller 157 may align the video data to generate pixel data matching a pixel arrangement structure, based on the timing synchronization signal, and may provide the generated pixel data to a corresponding data driving IC 153. Also, the timing controller 157 may generate the data control signal and a scan control signal based on the timing synchronization signal, may control a driving timing of each of the plurality of data driving ICs 153 according to the data control signal, and may control a driving timing of the scan driving circuit unit 160 according to the scan control signal. For example, the scan control signal may be supplied to the scan driving circuit unit 160 through a first or/and last flexible circuit film(s) of the plurality of flexible circuit films 151 and the non-display area NA of the first substrate 110.

The scan driving circuit unit 160 may be provided in the non-display area NA of the first substrate 110. The scan driving circuit unit 160 may generate a scan signal according to the scan control signal from the display driving circuit unit 150, and may supply the scan signal to a scan line corresponding to a predetermined order. According to an embodiment of the present disclosure, the scan driving circuit unit 160 may be formed in the non-display area NA of the first substrate 110 along with the TFT.

Figure 2:
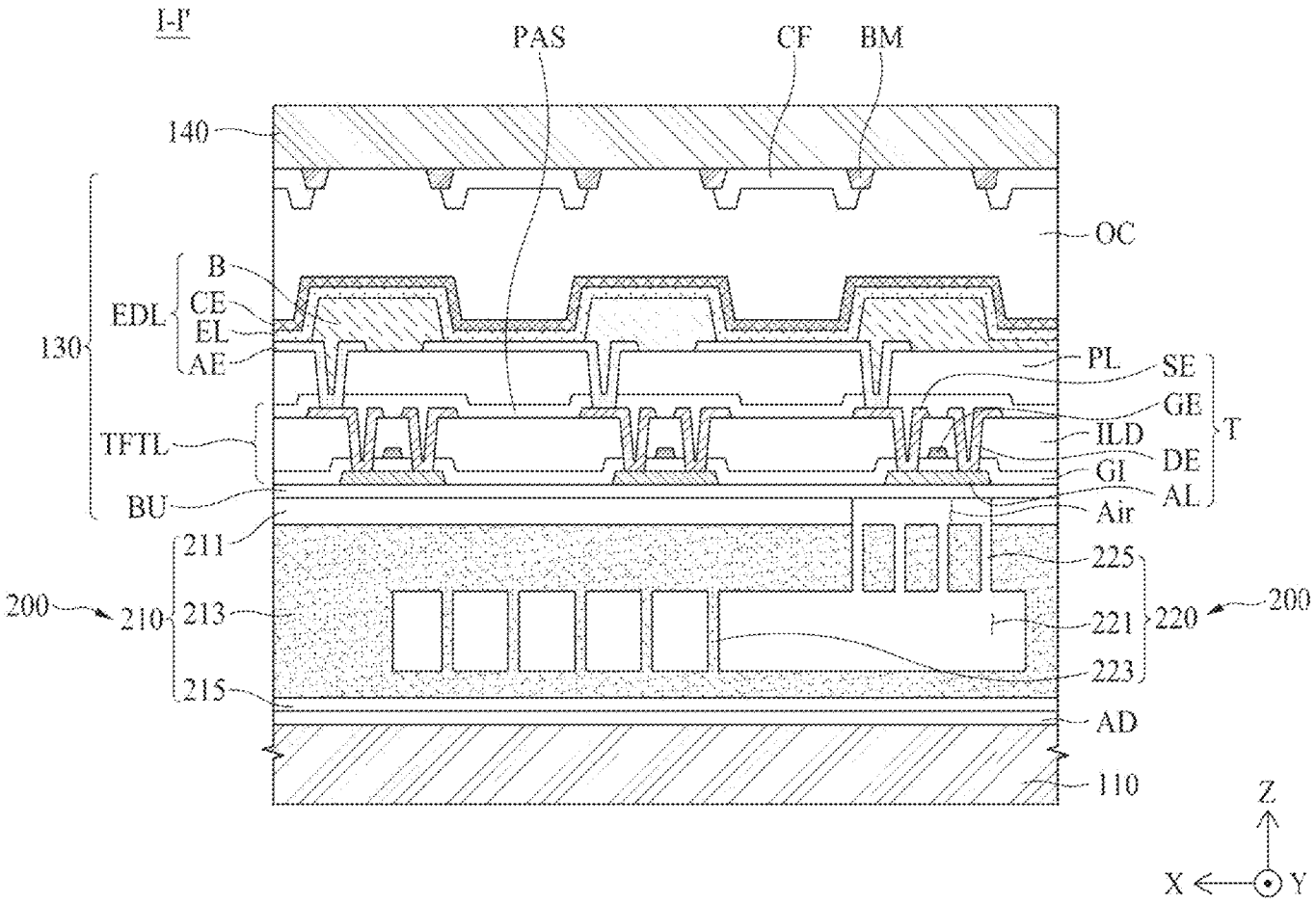
FIG. 2 is a cross-sectional view taken along line I-I' of FIG. 1.

FIG. 2 is a cross-sectional view taken along line I-I' of FIG. 1.

With reference to FIG. 2, a display apparatus 100 may include a first substrate 110, a pixel array layer 130, a second substrate 140, and a piezoelectric device 200. The first substrate 110 may be a base substrate, and may be a flexible substrate. The first substrate 110 may include a display area AA and a non-display area NA.

The piezoelectric device 200 may be on the first substrate 110, and may generate a vibration. The piezoelectric device 200 may be attached to the first substrate 110 by an adhesive layer AD. For example, the piezoelectric device 200 may be between the first substrate 110 and the pixel array layer 130. Therefore, the piezoelectric device 200 may overlap a TFT layer TFTL, a light-emitting device layer EDL, and a color filter CF. The piezoelectric device 200 may include first and second piezoelectric units 210 and 220.

The first piezoelectric unit 210 may receive a sound signal having an input frequency (e.g., corresponding to the input frequency) to vibrate at the input frequency, and may output sound toward a forward region in front of the display apparatus 100. The first piezoelectric unit 210 may include a first electrode 211, a vibration-generating layer 213, and a second electrode 215.

The first electrode 211 may be between the vibration-generating layer 213 and the TFT layer TFTL, and may overlap the display area AA of the first substrate 110. For example, the piezoelectric device 200 may be provided in plurality, and the display apparatus 100 may include the plurality of piezoelectric devices 200. Each of the first electrode 211 and the vibration-generating layer 213 may be provided in plurality. Each of the plurality of first electrodes 211 may be patterned between a corresponding vibration-generating layer 213 and the TFT layer TFTL to correspond to the corresponding vibration-generating layer 213 of the plurality of vibration-generating layers 213. The first electrode 211 may be connected to a pad part of the first substrate 110, and may receive a sound signal, e.g., synchronized with a data signal, from the display driving circuit unit 150.

The first electrode 211 may be disposed on a surface of the vibration-generating layer 213 where an air path 225 of the second piezoelectric unit 220 may be provided, to not overlap the air path 225. According to an embodiment of the present disclosure, each of the plurality of first electrodes 211 may be disposed between a corresponding vibration-generating layer 213 and the TFT layer TFTL to correspond to the corresponding vibration-generating layer 213 of the plurality of vibration-generating layers 213, and may be patterned to not overlap the air path 225 of the second piezoelectric unit 220. Accordingly, an air layer Air may be between the air path 225 and the TFT layer TFTL, and a vibration output from the air path 225 may be transferred to the TFT layer TFTL.

The vibration-generating layer 213 may be between the first and second electrodes 211 and 215. When a voltage is applied to the first and second electrodes 211 and 215, the vibration-generating layer 213 may vibrate to output sound. According to an embodiment of the present disclosure, the display driving circuit unit 150 may provide the sound signal to the first electrode 211. Also, when a voltage is applied to the first and second electrodes 211 and 215, the vibration-generating layer 213 may vibrate based on a magnetic field, according to an inverse piezoelectric effect. For example, the vibration-generating layer 213 may be formed through a sputtering process using a piezoelectric material, but is not limited thereto.

According to an embodiment of the present disclosure, the vibration-generating layer 213 may include a piezoelectric material having a piezoelectric effect. For example, the piezoelectric effect may denote a characteristic such that, when an external force is applied, electrical polarization may occur to cause a potential difference, but when a voltage is applied, deformation or a deformation force may occur. For example, the piezoelectric material may include a piezopolymer, including at least one of: polyvinylidene fluoride (PVDF) homopolymer, PVDF copolymer, PVDF terpolymer, cyano-polymer, cyano-copolymer, and boron nitride (BN) polymer, but is not limited thereto. For example, the PVDF copolymer may be, for example, polyvinylidene fluoride trifluoroethylene P(VDF-TrFe), PVDF-TFE, PVDF-CTFE, or PVDF-CFE, but is not limited thereto. Also, the PVDF terpolymer may be, for example, PVDF-TrFe-CFE or PVDF-TrFE-CTFE, but is not limited thereto. Also, the cyano-polymer may be, for example, PVDCN-vinyl acetate or PVDCN-vinyl propionate, but is not limited thereto. Also, the BN polymer may be, for example, polyaminoboran or polyaminodifluoroboran, but is not limited thereto. As another example, the piezoelectric material may include perovskite oxide such as $PbZrO_3$—$PbTiO_3$, lead zirconate titanate (PLZT), or barium titanate ($Ba_2TiO_4$ (or $BaTiO_3$)), or may include ceramics, such as lithium niobate ($LiNbO_3$) or lithium tantalate ($LiTaO_3$) having a piezoelectric characteristic.

As another example, the piezoelectric material may include a composite, which may include at least one piezoelectric ceramic, including one or more of: $PbZrO_3$—$PbTiO_3$, barium titanate ($BaTiO_3$), zinc oxide (ZnO), gallium nitride (GaN), and aluminum nitride (AlN) and at least one polymer, including one or more of: PVDF, PDMS, polyimide, PVDF-TrFE, PVDF-TrFE-CFE, PVDF-HFP, silicon, rubber, and epoxy. As another example, the piezoelectric device 200 may be a transparent piezoelectric device having a Wurtzite structure, and for example, may include one or more of AlN, ZnO, and lithium niobate ($LiNbO_3$), but is not limited thereto.

The second electrode 215 may be on a surface of the first substrate 110 facing the second substrate 140, and may overlap the display area AA of the first substrate 110. For example, the display apparatus 100 may include the plurality of piezoelectric devices 200, and the second electrode 215 may be a common electrode between the first substrate 110 and the vibration-generating layer 213. As another example, the display apparatus 100 may include the plurality of piezoelectric devices 200. For example, each of the plurality of first electrodes 211 may be between a corresponding vibration-generating layer 213 and the TFT layer TFTL to correspond to the corresponding vibration-generating layer 213 of the plurality of vibration-generating layers 213. The plurality of second electrodes 215 may be patterned on the first substrate 110 to respectively correspond to the plurality of first electrodes 211.

According to an embodiment of the present disclosure, the display apparatus 100 may control a sound signal having an input frequency provided to the first and second electrodes 211 and 215 to vibrate the piezoelectric device 200, and a vibration may be transferred to the display apparatus 100, thereby outputting sound toward a forward region in front of the display apparatus 100. Therefore, the display apparatus 100 may output the sound toward the forward region in front of the display apparatus 100 even without including a separate vibration generating device. Thus, an image generating position may match a sound generating position of the sound, thereby enhancing an immersion experience of a viewer or user watching an image, and enhancing a degree of design freedom of the display apparatus 100.

The second piezoelectric unit 220 may receive a vibration of the first piezoelectric unit 210 to output a vibration having a frequency differing from the input frequency. The second piezoelectric unit 220 may include an air gap 221, a supporting member 223, and an air path 225. According to an embodiment of the present disclosure, the second piezoelectric unit 220 may output a vibration having a frequency determined based on a volume of the air gap 221, a length of the air path 225, and a cross-sectional area of the air path 225. For example, when a volume of the air gap 221 or a length of the air path 225 increases, a frequency may decrease. When a cross-sectional area of the air path 225 increases, a frequency may increase. Therefore, the piezoelectric device 200 may output a vibration having the input frequency through the first piezoelectric unit 210, and may output a vibration having a frequency differing from the input frequency through the second piezoelectric unit 220. Also, the second piezoelectric unit 220 may set a frequency based on a volume of the air gap 221, a length of the air path 225, and a cross-sectional area of the air path 225, thereby enhancing a sound pressure level (SPL) corresponding to a fixed frequency.

The air gap 221 may be in the second piezoelectric unit 220, and may have a certain volume. According to an embodiment of the present disclosure, the air gap 221 may receive a vibration from the first piezoelectric unit 210, and may transfer the vibration to the air path 225. Accordingly, a vibration provided in the air gap 221 may be discharged through the air path 225. For example, the air gap 221 may be formed simultaneously in a process of forming the vibration-generating layer 213.

The supporting member 223 may be in the air gap 221, and may support or define the air gap 221. According to an embodiment of the present disclosure, the supporting member 223 may extend from one surface of the air gap 221 to the other surface facing the one surface in a thickness direction of the piezoelectric device 220. Therefore, the supporting member 223 may connect the one surface and the other surface of the air gap 221 to support or define the air gap 221. The position and thickness of the supporting member 223 and the number of supporting members 223 are not limited. For example, the supporting member 223 may be configured to support the air gap 221 without any change in volume of the air gap 221.

According to an embodiment of the present disclosure, the supporting member 223 may be formed of the same material as that of the vibration-generating layer 213, and may be formed simultaneously through a sputtering process in a process of forming the vibration-generating layer 213, but is not limited thereto. According to an embodiment of the present disclosure, the supporting member 223 may be in one portion of the air gap 221, and the air path 225 may be in the other portion opposite to the one portion of the air gap 221. The air gap 221 may receive a vibration of the vibration-generating layer 213, and may transfer the vibration to the air path 225 in a state that may maintain the vibration in the air gap 221. For example, when the vibration is transferred from the vibration-generating layer 213, the air gap 221 may transfer the vibration toward the air path 225 at a position spaced relatively far apart from the air path 225. Also, the vibration transferred to the air path 225 may have a frequency based on the frequency when the vibration is output from the air path 225.

When a volume of the air gap 221 is a factor that determines a frequency of the vibration output from the second piezoelectric unit 220, the air gap 221 may maintain a certain volume. As a volume of the air gap 221 increases, it may be difficult for the piezoelectric device 200 to maintain a volume of the air gap 221. Therefore, as a volume of the air gap 221 increases, the second piezoelectric unit 220 may have an increase in the thickness or number of the supporting members 223 to stably maintain a volume of the air gap 221.

According to another embodiment of the present disclosure, the air path 225 may be connected to a center portion of the air gap 221, and the supporting member 223 may be disposed in each of both side portions of the air gap 221. For example, when the vibration-generating layer 213 transfers the vibration to the air gap 221, a plurality of vibrations generated at a plurality of positions spaced relatively far apart from the air path 225 may travel toward the air path 225, and the air gap 221 may combine the plurality of vibrations to transfer a combination vibration to the air path 225. Also, the vibration transferred to the air path 225 may have a frequency based on the frequency when the vibration is output from the air path 225.

According to an embodiment of the present disclosure, a length of the air path 225 may be longer than a width of the air gap 221. As a length of the air path 225 increases, a frequency of a vibration output from the second piezoelectric unit 220 may decrease. Thus, the display apparatus 100 may increase a length of the air path 225 to enhance a low-pitched sound output characteristic of the piezoelectric device 200.

According to an embodiment of the present disclosure, the supporting member 223 may be omitted, and the second piezoelectric unit 220 may include only the air gap 221 and the air path 225. For example, the air gap 221 may have a shape for maintaining a volume and a structure, even without the supporting member 223. Accordingly, the second piezoelectric unit 220 may include the air gap 221, which may maintain a volume and a structure without the supporting member 223, and the air path 225, which may connect the air gap 221 to an outer portion of the vibration-generating layer 213.

The air path 225 may connect the air gap 221 to an outer portion of the vibration-generating layer 213. The air path 225 may output a vibration, transferred from the air gap 221, to the outside of the vibration-generating layer 213. A vibration output from the air path 225 may have a frequency. For example, the frequency may be determined based on a volume of the air gap 221, a length of the air path 225, and a cross-sectional area of the air path 225. For example, when the volume of the air gap 221 or the length of the air path 225 increases, the frequency may decrease. When the cross-sectional area of the air path 225 increases, the frequency may increase.

According to an embodiment of the present disclosure, a vibration output from the second piezoelectric unit 220 may have a frequency determined as expressed in the following Equation. For example, 'f' denotes a frequency (Hz), 'c' denotes a velocity of a sound wave, 'V' denotes a volume of the air gap 221, denotes a length of the air path 225, and 'A' denotes a cross-sectional area of the air path 225.

$$f = \frac{c}{2\pi}\sqrt{\frac{A}{VL}}$$ [Equation]

Therefore, the frequency may be proportional to the cross-sectional area of the air path 225, and may be inversely proportional to the volume of the air gap 221 or the length of the air path 225. For example, when the cross-sectional area of the air path 225 increases, the frequency may increase. When the volume of the air gap 221 or the length of the air path 225 increases, the frequency may decrease.

Therefore, when the display apparatus 100 according to an embodiment of the present disclosure includes the piezoelectric device 200 including the first and second piezoelectric units 210 and 220, the display apparatus 100 may output sound of a whole domain or sound band range (for example, 20 Hz to 20 kHz) of an audible frequency through the first piezoelectric unit 210, and may output sound of a low frequency domain (for example, 200 Hz or less) through the second piezoelectric unit 220. Therefore, the display apparatus 100 according to an embodiment of the present disclosure may use the second piezoelectric unit 220 as a low-pitched sound speaker, such as a woofer, thereby enhancing a low-pitched sound output characteristic of the piezoelectric device 200.

The pixel array layer 130 may include a buffer layer BU, a TFT layer TFTL, a planarization layer PL, a light-emitting device layer EDL, an overcoat layer OC, a color filter CF, and a black matrix BM. The buffer layer BU may be on the piezoelectric device 200. According to an embodiment of the present disclosure, the buffer layer BU may be formed by stacking a plurality of inorganic layers. For example, the buffer layer BU may be formed of a multilayer in which one or more inorganic layers of silicon oxide ($SiO_x$), silicon nitride ($SiN_x$), and silicon oxynitride (SiON) may be stacked, but is not limited thereto. The buffer layer BU may be provided on a whole upper surface of the piezoelectric device 200, e.g., for reducing or preventing water or moisture from penetrating into the light-emitting device layer EDL through the first substrate 110. Accordingly, when the buffer layer BU includes a plurality of inorganic layers, a water vapor transmission rate (WVTR) of a display panel may be enhanced. The buffer layer BU may be omitted.

The TFT layer TFTL may include a TFT T, a gate insulation layer GI, an interlayer insulation layer ILD, and a passivation layer PAS. The TFT T may be on the display area AA of the first substrate 110. The TFT T may include a semiconductor layer AL, a gate electrode GE, a drain electrode DE, and a source electrode SE.

The semiconductor layer AL may be on the display area AA of the first substrate 110. The semiconductor layer AL may overlap the gate electrode GE, the drain electrode DE, and the source electrode SE. The semiconductor layer AL may directly contact the drain electrode DE and the source electrode SE, and may face the gate electrode GE with the gate insulation layer GI therebetween.

The gate electrode GE may be on the gate insulation layer GI. The gate electrode GE may overlap the semiconductor layer AL, with the gate insulation layer GI therebetween.

The drain electrode DE and the source electrode SE may be provided apart from each other on the interlayer insulation layer ILD. The drain electrode DE may contact one portion of the semiconductor layer AL through a first contact hole in the gate insulation layer GI and the interlayer insulation layer ILD. The source electrode SE may contact the other portion of the semiconductor layer AL through a second contact hole in the gate insulation layer GI and the interlayer insulation layer ILD. The source electrode SE may directly contact an anode electrode AE through a third contact hole of the passivation layer PAS.

The gate insulation layer GI may be on the semiconductor layer AL. For example, the gate insulation layer GI may be on the semiconductor layer AL and the buffer layer BU, and may insulate the semiconductor layer AL from the gate electrode GE. Also, the gate insulation layer GI may be on an entire surface of the display area AA of the first substrate 110. For example, the gate insulation layer GI may include the first contact hole, through which the drain electrode DE may pass, and the second contact hole, through which the source electrode SE may pass.

The interlayer insulation layer ILD may be on the gate electrode GE. For example, the interlayer insulation layer ILD may include the first contact hole, through which the drain electrode DE may pass, and the second contact hole, through which the source electrode SE may pass. For example, each of the first contact hole and the second contact hole of the interlayer insulation layer ILD may be respectively connected to the first contact hole or the second contact hole of the gate insulation layer GI.

The passivation layer PAS may be on the TFT T, and may protect the TFT T. For example, the passivation layer PAS may include the third contact hole through which the anode electrode AE may pass.

The planarization layer PL may be on the passivation layer PAS, and may planarize an upper end of the TFT T. For example, the planarization layer PL may include the third contact hole, through which the anode electrode AE may pass. For example, the third contact hole of the passivation layer PAS and the third contact hole of the planarization layer PL may be connected to each other for allowing the anode electrode AE to pass therethrough.

The light-emitting device layer EDL may be on the passivation layer PAS, and may be electrically connected to the TFT T. The light-emitting device layer EDL may include the anode electrode AE, a light-emitting layer EL, a cathode electrode CE, and a bank B. Also, the light-emitting device layer EDL may include an organic light-emitting layer, an inorganic light-emitting layer, or a micro light-emitting diode, but is not limited thereto.

The anode electrode AE may be on the planarization layer PL. For example, the anode electrode AE may overlap an opening region of the light-emitting device layer EDL defined by the bank B. Also, the anode electrode AE may contact the source electrode SE of the TFT T through the third contact hole provided in the planarization layer PL and the passivation layer PAS. According to an embodiment of the present disclosure, the anode electrode AE may include a transparent conductive material, and may act as an anode.

The light-emitting layer EL may be on the anode electrode AE. According to an embodiment of the present disclosure, the light-emitting layer EL may not be divided by units of pixel areas, and may be implemented in a form of an organic layer, which may be common in all of the pixels P. Also, the light-emitting layer EL may be provided on the bank B, as well as on the anode electrode AE. For example, the light-emitting layer EL may include a hole transporting layer, a light-emitting layer, and an electron transporting layer, but is not limited thereto.

The cathode electrode CE may be on the light-emitting layer EL. For example, the cathode electrode CE may not be divided by units of pixel areas, and may be implemented in an electrode form, which may be common in all of the pixels P. When a voltage may be applied to the anode electrode AE and the cathode electrode CE, a hole and an electron may respectively move to the light-emitting layer EL through the hole transporting layer and the electron transporting layer, and may be combined in the light-emitting layer to emit light. The cathode electrode CE may act as a cathode of the light-emitting device layer EDL.

The bank B may be on the passivation layer PAS. For example, the bank B may be between anode electrodes AE that are adjacent to each other, and may divide the anode electrodes AE. Therefore, the bank B may electrically insulate adjacent anode electrodes AE, and may provide an opening region of the light-emitting device layer EDL as an emitting region.

The overcoat layer OC may cover the light-emitting device layer EDL. For example, the overcoat layer OC may be in a whole upper portion of the cathode electrode CE. The overcoat layer OC may reduce or prevent penetration of water or moisture flowing in from the outside to reduce or prevent degradation in the light-emitting layer EL.

The color filter CF may be on the overcoat layer OC, and may correspond to the emitting region of the light-emitting device layer EDL. For example, the color filter CF may be surrounded by the black matrix BM, which may be patterned on the overcoat layer OC. The color filter CF may be provided in plurality, and the plurality of color filters CF may be spaced apart from one another to respectively correspond to a plurality of emitting regions of the light-emitting device layer EDL. Also, the plurality of color filters CF may be disposed to respectively correspond to the plurality of emitting regions of the light-emitting device layer EDL, and each of the color filters CF may convert a color of white light emitted from the light-emitting device layer EDL. For example, the color filters CF may include a red color filter, a green color filter, and a blue color filter. Therefore, a red subpixel, a green subpixel, and a blue subpixel of the plurality of subpixels may each include a corresponding color filter CF, and a white subpixel may be implemented without a color filter.

The black matrix BM may be patterned on a surface of the second substrate 140 facing the first substrate 110. For example, the black matrix BM may be provided. Each of the plurality of the black matrixes BM may be between two adjacent color filters CF of the plurality of color filters CF, and may divide the plurality of color filters CF. For example, the black matrix BM may surround the opening region of the light-emitting device layer EDL, and may block light incident on the TFT T.

The first substrate 110 may be attached to the second substrate 140, and may face each other. For example, each of the first and second substrates 110 and 140 may be a base substrate, and may be a flexible substrate. For example, each of the first and second substrates 110 and 140 may include a transparent polyimide material. For example, each of the first and second substrates 110 and 140 may use a sheet or a film, which may include a cellulose resin, such as triacetyl cellulose (TAC) or diacetyl cellulose (DAC); an acryl resin, such as cyclic olefin polymer (COP) or cyclic olefin copolymer (COC), such as norbornene derivatives, or poly(methylmethacrylate) (PMMA); a polyolefin, such as polycarbonate (PC), polyethylene (PE), or polypropylene (PP); a polyester, such as polyvinyl alcohol (PVA), polyethersulfone (PES), polyetheretherketone (PEEK), polyetherimide (PEI), polyethylenenaphthalate (PEN), or polyethyleneterephthalate (PET); polyimide (PI); polysulfone (PES); or a fluorine resin, but is not limited thereto.

Figure 3:
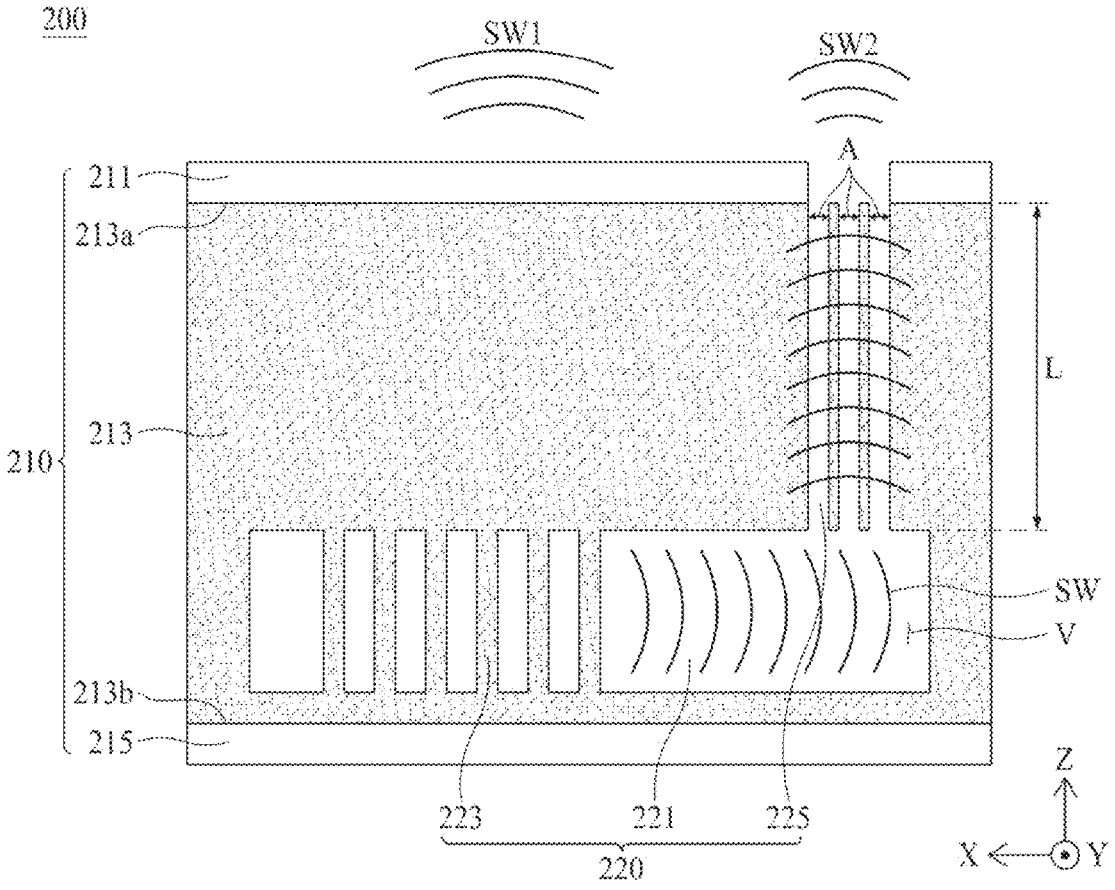
FIG. 3 is a cross-sectional view illustrating an embodiment of a piezoelectric device in a display apparatus according to an embodiment of the present disclosure.
Figure 4:
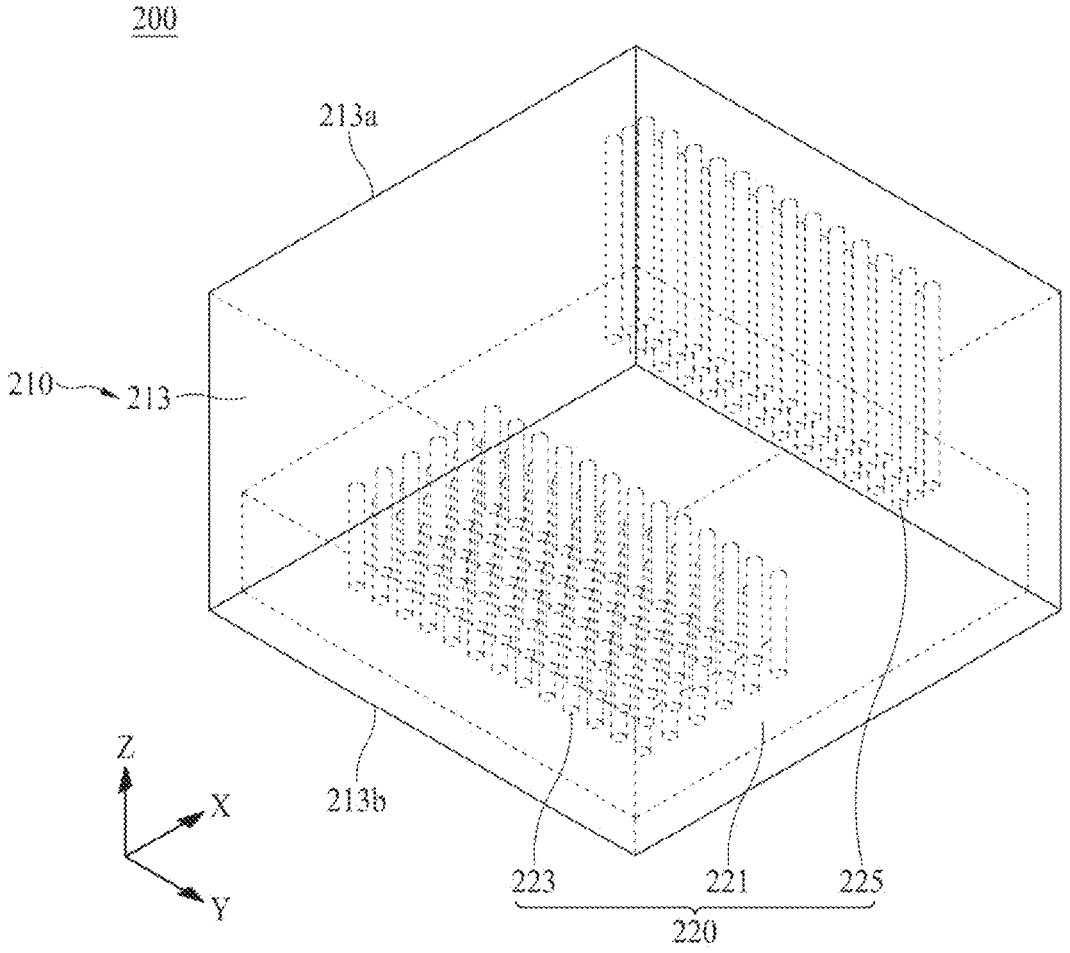
FIG. 4 is a perspective view illustrating the piezoelectric device of FIG. 3.
Figure 5:
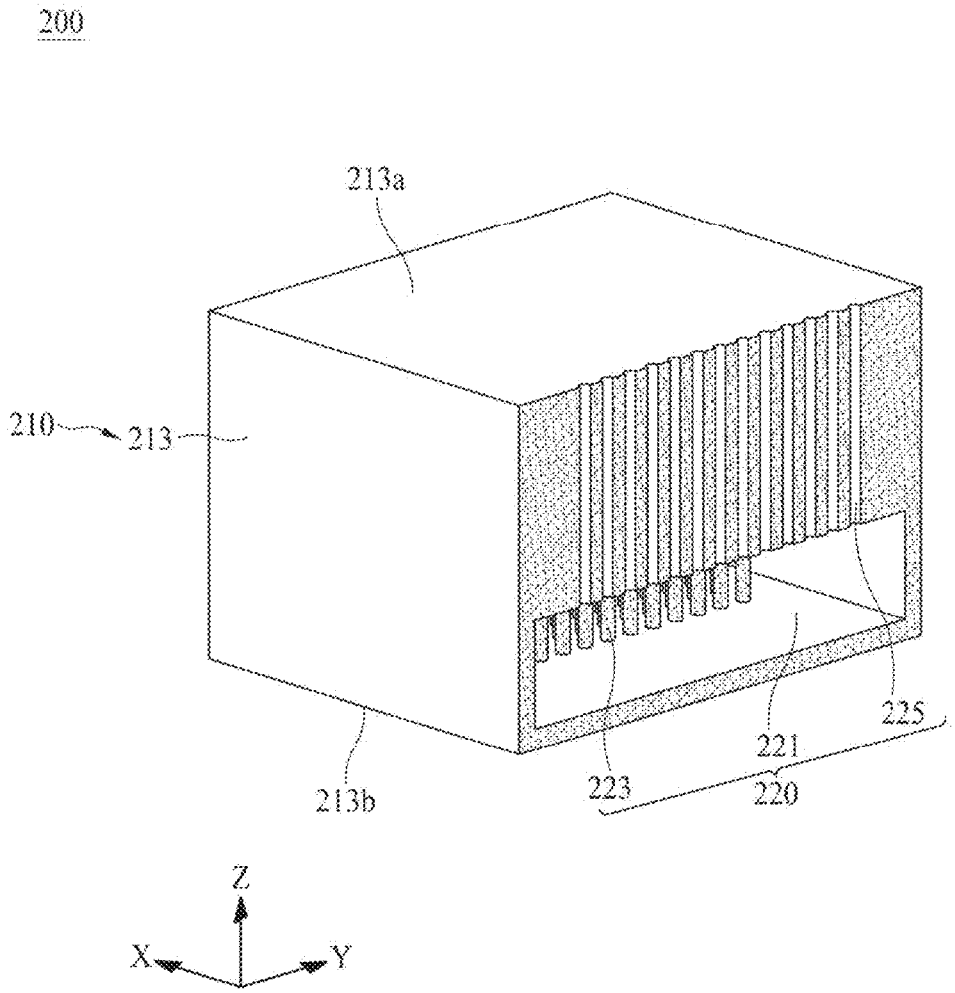
FIG. 5 is another perspective view illustrating the piezoelectric device of FIG. 3.
Figure 6:
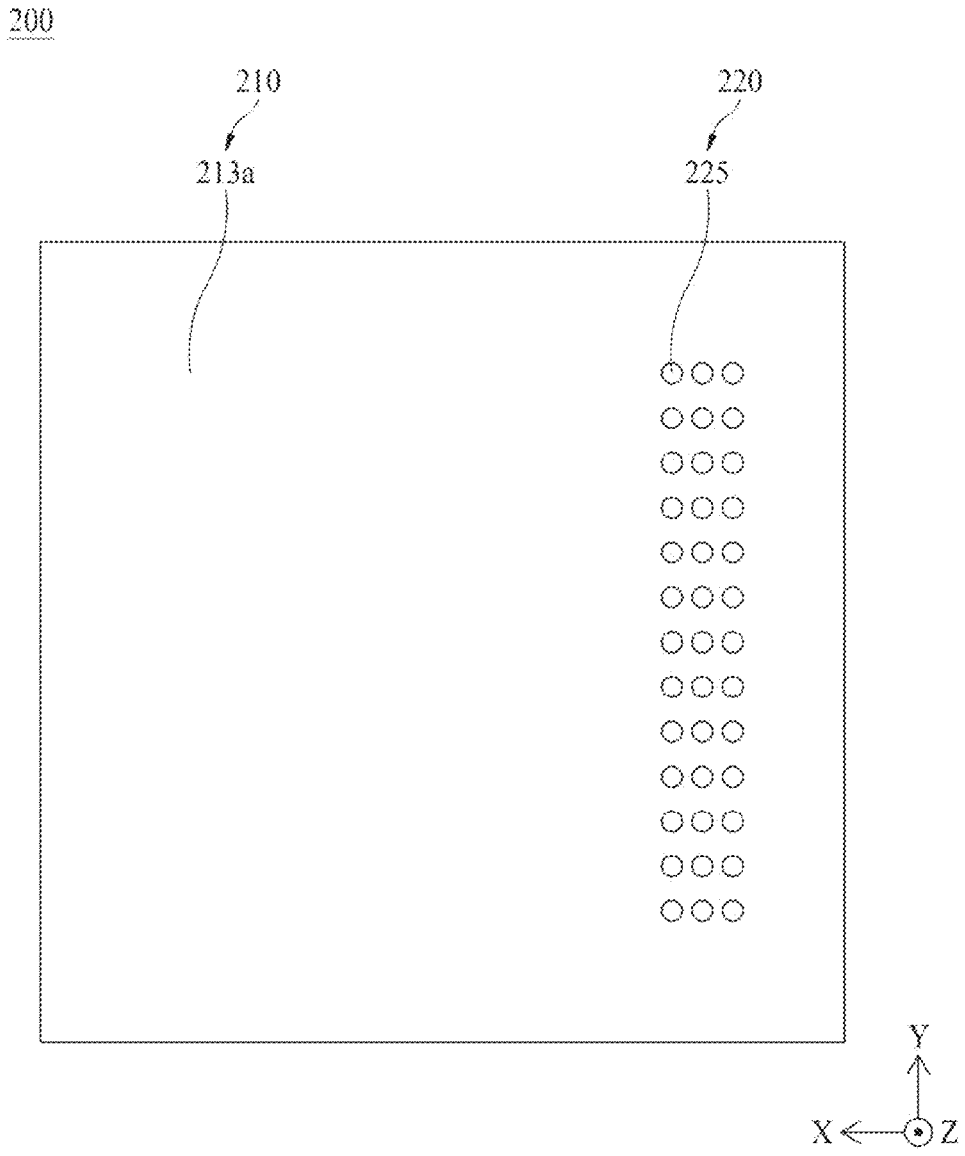
FIG. 6 is a plan view illustrating the piezoelectric device of FIG. 3.

FIG. 3 is a cross-sectional view illustrating an embodiment of a piezoelectric device in a display apparatus according to an embodiment of the present disclosure. FIG. 4 is a perspective view illustrating the piezoelectric device of FIG. 3. FIG. 5 is another perspective view illustrating the piezoelectric device of FIG. 3. FIG. 6 is a plan view illustrating the piezoelectric device of FIG. 3.

With reference to FIGS. 3 to 6, the piezoelectric device 200 may be on a first substrate 110, and may generate a vibration. The piezoelectric device 200 may include first and second piezoelectric units 210 and 220.

The first piezoelectric unit 210 may receive a sound signal having an input frequency (e.g., corresponding to the input frequency) to vibrate at the input frequency and may output sound SW1 toward a forward region in front of the display apparatus 100. The first piezoelectric unit 210 may include a first electrode 211, a vibration-generating layer 213, and a second electrode 215.

The first electrode 211 may be between the vibration-generating layer 213 and a TFT layer TFTL, and may overlap a display area AA of the first substrate 110. The first electrode 211 may face the second electrode 215, with the vibration-generating layer 213 therebetween. For example, each of the first electrode 211 and the vibration-generating layer 213 may be provided in plurality, and each of the plurality of first electrodes 211 may be patterned between a corresponding vibration-generating layer 213 and the TFT layer TFTL, and may correspond to the corresponding vibration-generating layer 213 of the plurality of vibration-generating layers 213.

The first electrode 211 may be on a surface of the vibration-generating layer 213 where an air path 225 of the second piezoelectric unit 220 may be provided, and may not overlap the air path 225. According to an embodiment of the present disclosure, each of the plurality of first electrodes 211 may be disposed between a corresponding vibration-generating layer 213 and the TFT layer TFTL to correspond to the corresponding vibration-generating layer 213 of the plurality of vibration-generating layers 213, and may be patterned to not overlap the air path 225 of the second piezoelectric unit 220. Accordingly, an air layer Air may be provided between the air path 225 and the TFT layer TFTL, and a vibration output from the air path 225 may be transferred to the TFT layer TFTL.

The vibration-generating layer 213 may be between the first and second electrodes 211 and 215. When the sound signal having the input frequency is supplied to the first and second electrodes 211 and 215, the vibration-generating layer 213 may output the sound SW1, which may vibrate at the input frequency. One surface of the vibration-generating layer, e.g., a first surface 213*a*, or an upper surface of the vibration-generating layer 213, may face the first electrode 211. The other surface of the vibration-generating layer, e.g., a second surface 213*b*, or a lower surface of the vibration-generating layer 213 opposite to the first surface 213*a*, may face the second electrode 215.

The first and second electrodes 211 and 215 may receive the sound signal from a display driving circuit unit 150, and the vibration-generating layer 213 may vibrate with a magnetic field, based on an inverse piezoelectric effect. For example, the vibration-generating layer 213 may be formed through a sputtering process using a piezoelectric material, but is not limited thereto.

The second electrode 215 may be on one surface of the first substrate 110 facing the second substrate 140, and may overlap the display area AA of the first substrate 110. For example, the second electrode 215 may be a common electrode or one electrode without pattering between the first substrate 110 and the vibration-generating layer 213. As another example, each of the plurality of first electrodes 211 may be disposed between a corresponding vibration-generating layer 213 and the TFT layer TFTL, and may correspond to the corresponding vibration-generating layer 213 of the plurality of vibration-generating layers 213. The plurality of second electrodes 215 may be patterned on the first substrate 110 to respectively correspond to the plurality of first electrodes 211.

The second piezoelectric unit 220 may receive a vibration of the first piezoelectric unit 210 to output sound SW2, which may vibrate at a frequency differing from the input frequency. The second piezoelectric unit 220 may include an air gap 221, a supporting member 223, and an air path 225. According to an embodiment, the second piezoelectric unit 220 may output a vibration having a frequency determined based on a volume V of the air gap 221, a length L of the air path 225, and a cross-sectional area A of the air path 225. For example, when the volume V of the air gap 221 or the length L of the air path 225 increases, the frequency may decrease. When the cross-sectional area A of the air path 225 increases, the frequency may increase. Therefore, the piezoelectric device 200 may output, through the first piezoelectric unit 210, the sound SW1, which may vibrate at the input frequency, and may output, through the second piezoelectric unit 220, the sound SW2, which may vibrate at a frequency differing from the input frequency. Also, the second piezoelectric unit 220 may adjust the frequency based on the volume V of the air gap 221, the length L of the air path 225, and the cross-sectional area A of the air path 225, thereby enhancing a sound pressure level (SPL) corresponding to the frequency.

The air gap 221 may be in the first piezoelectric unit 210, and may have a certain volume V. According to an embodiment of the present disclosure, the air gap 221 may receive a vibration from the first piezoelectric unit 210, and may transfer the vibration to the air path 225. Accordingly, a vibration provided in the air gap 221 may be discharged through the air path 225. For example, the air gap 221 may be formed simultaneously in a process of forming the vibration-generating layer 213.

The supporting member 223 may be in the air gap 221, and may support or define the air gap 221. According to an embodiment of the present disclosure, the supporting member 223 may extend from one surface of the air gap 221 to the other surface facing the one surface in a thickness direction of the piezoelectric device 220. Therefore, the supporting member 223 may connect the one surface and the other surface of the air gap 221 to support or define the air gap 221. The position and thickness of the supporting member 223 and the number of supporting members 223 are not limited, and the supporting member 223 may be configured to support or define the air gap 221 without any change in volume V of the air gap 221. According to an embodiment of the present disclosure, the supporting member 223 may be formed of the same material as that of the vibration-generating layer 213, and may be formed simultaneously through a sputtering process in a process of forming the vibration-generating layer 213, but is not limited thereto.

According to an embodiment of the present disclosure, the supporting member 223 may be in one portion of the air gap 221, and the air path 225 may be in the other portion opposite to the one portion of the air gap 221. The air gap 221 may receive a vibration of the vibration-generating layer 213, and may transfer the vibration to the air path 225 in a state that may maintain the vibration in the air gap 221. For example, when the vibration is transferred from the vibration-generating layer 213, the air gap 221 may transfer the vibration toward the air path 225 at a position spaced relatively far apart from the air path 225. Also, the vibration transferred to the air path 225 may have a frequency based on the frequency when the vibration is output from the air path 225.

When the volume V of the air gap 221 is used to determine a frequency of the vibration output from the second piezoelectric unit 220, the air gap 221 may maintain a certain volume V. If the volume V of the air gap 221 were to be made larger, it may be more difficult for the piezoelectric device 200 to maintain the volume V of the air gap 221. Therefore, as the volume V of the air gap 221 increases, the second piezoelectric unit 220 may increase the thickness or number of the supporting members 223 to stably maintain the volume V of the air gap 221.

The air path 225 may connect the air gap 221 to an outer portion of the vibration-generating layer 213. The air path 225 may output the sound SW2, transferred from the air gap 221, to the outside of the vibration-generating layer 213, and the sound SWA2 output from the air path 225 may have a frequency. For example, the frequency may be determined based on the volume V of the air gap 221, the length L of the air path 225, and the cross-sectional area A of the air path 225.

According to an embodiment of the present disclosure, a vibration output from the second piezoelectric unit 220 may have a frequency determined as expressed in the Equation defined above. Therefore, the frequency may be proportional to the cross-sectional area A of the air path 225, and may be inversely proportional to the volume V of the air gap 221 or the length L of the air path 225. For example, when the cross-sectional area A of the air path 225 increases, the frequency may increase. When the volume V of the air gap 221 or the length L of the air path 225 increases, the frequency may decrease.

The display apparatus 100 may control the sound signal having the input frequency provided to the first and second electrodes 211 and 215 to vibrate the piezoelectric device 200. A vibration may be transferred to the display apparatus 100, thereby outputting the sound SW1 having the input frequency and the sound SW2 having the frequency toward a forward region in front of the display apparatus 100. Therefore, the display apparatus 100 may output the sound toward the forward region in front of the display apparatus 100, even without including a separate vibration generating device. Thus, an image generating position may match a sound generating position of the sound, thereby enhancing an immersion experience of a viewer watching an image, and enhancing a degree of design freedom of the display apparatus 100.

Therefore, when the display apparatus 100 according to an embodiment of the present disclosure includes the piezoelectric device 200 including the first and second piezoelectric units 210 and 220, the display apparatus 100 may output a sound of a whole domain (for example, 20 Hz to 20 kHz) of an audible frequency through the first piezoelectric unit 210, and may output sound of a low frequency domain (for example, 200 Hz or less) through the second piezoelectric unit 220. Therefore, the display apparatus 100 according to an embodiment of the present disclosure may use the second piezoelectric unit 220 as a dedicated low-pitched sound speaker, such as a woofer, thereby enhancing a low-pitched sound output characteristic of the piezoelectric device 200.

Figure 7:
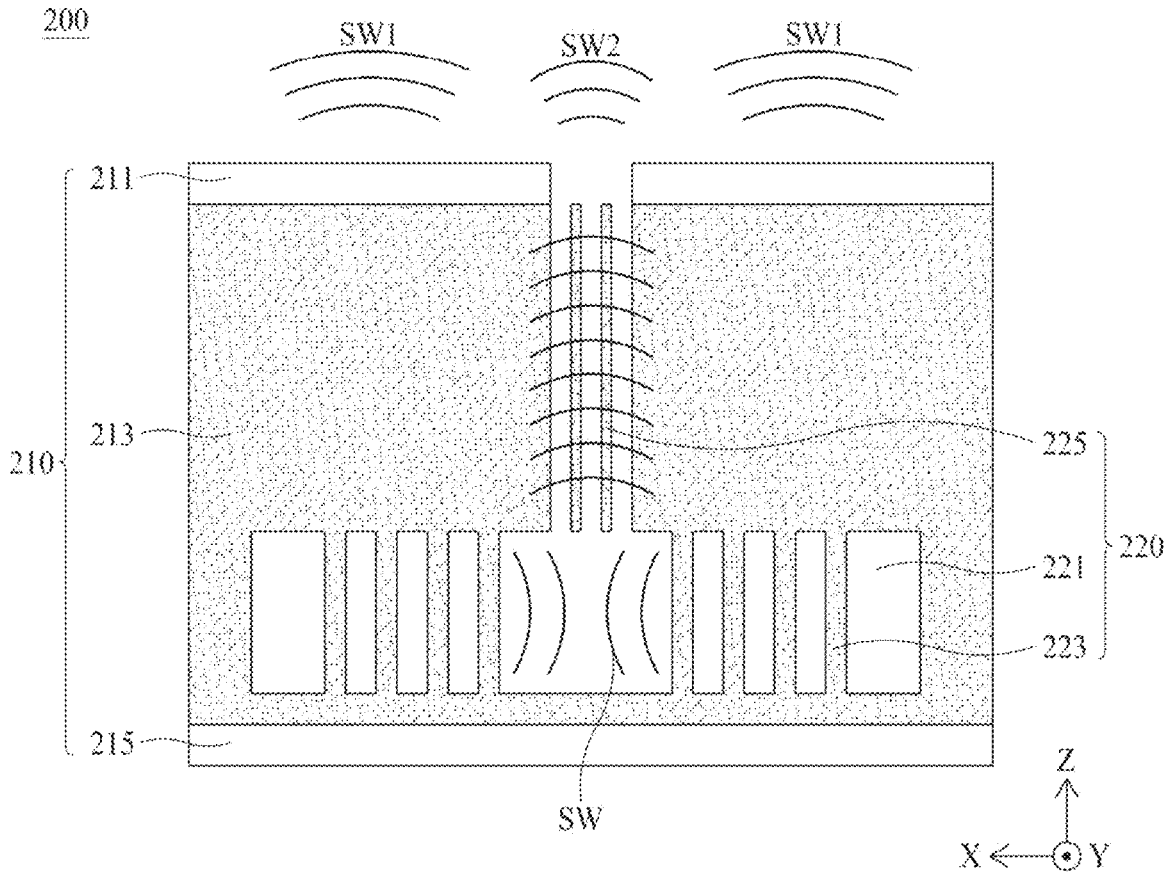
FIG. 7 is a cross-sectional view illustrating another embodiment of a piezoelectric device in a display apparatus according to an embodiment of the present disclosure.

FIG. 7 is a cross-sectional view illustrating another embodiment of a piezoelectric device in a display apparatus according to an embodiment of the present disclosure.

A piezoelectric device 200 of FIG. 7 may be implemented by changing only positions of the piezoelectric device, the supporting member 223, and the air path 225 of the examples of FIGS. 3 to 6. Thus, descriptions of the same elements as the above-described elements will be briefly given below or may be omitted.

With reference to FIG. 7, an air path 225 may be connected to a center portion of an air gap 221, and a supporting member 223 may be disposed in each of both sides of the air gap 221. For example, when a vibration-generating layer 213 transfers the vibration to the air gap 221, a plurality of vibrations (e.g., sound waves SW) generated at a plurality of positions spaced relatively far apart from the air path 225 may travel toward the air path 225, and the air gap 221 may combine the plurality of vibrations to transfer a combination vibration to the air path 225. Also, the combination vibration transferred to the air path 225 may have a frequency based on the frequency when the vibration is output from the air path 225.

Figure 8:
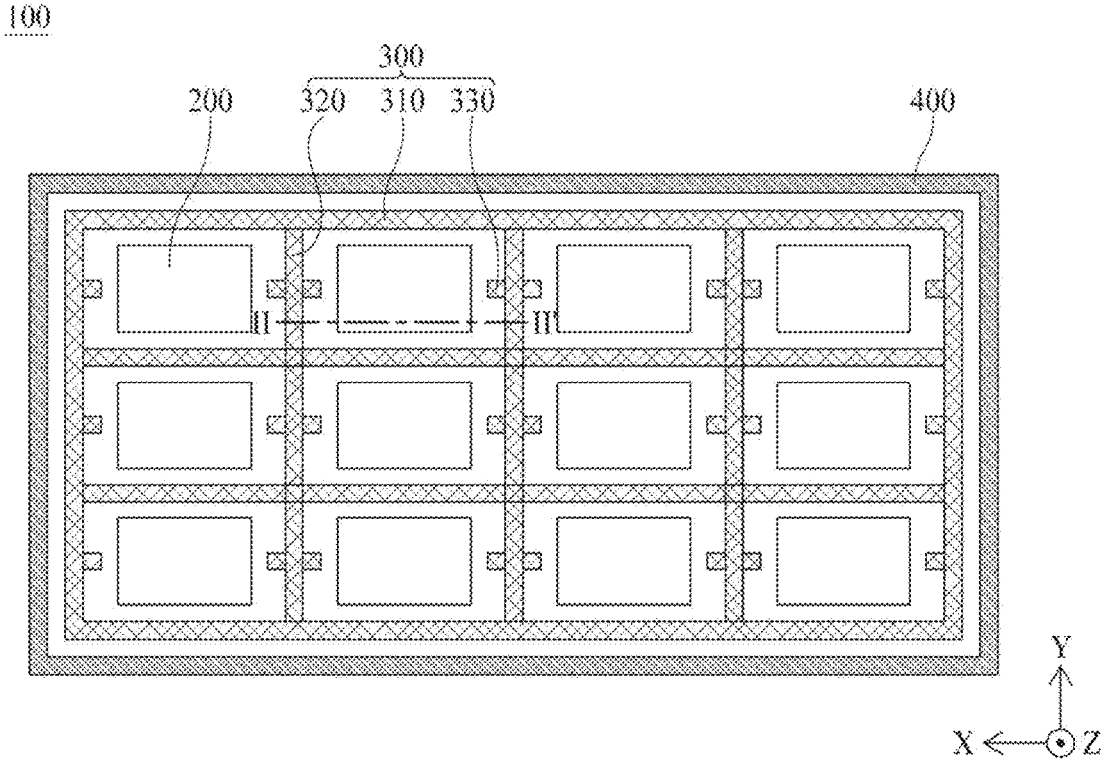
FIG. 8 is a plan view illustrating a display apparatus according to another embodiment of the present disclosure.
Figure 9:
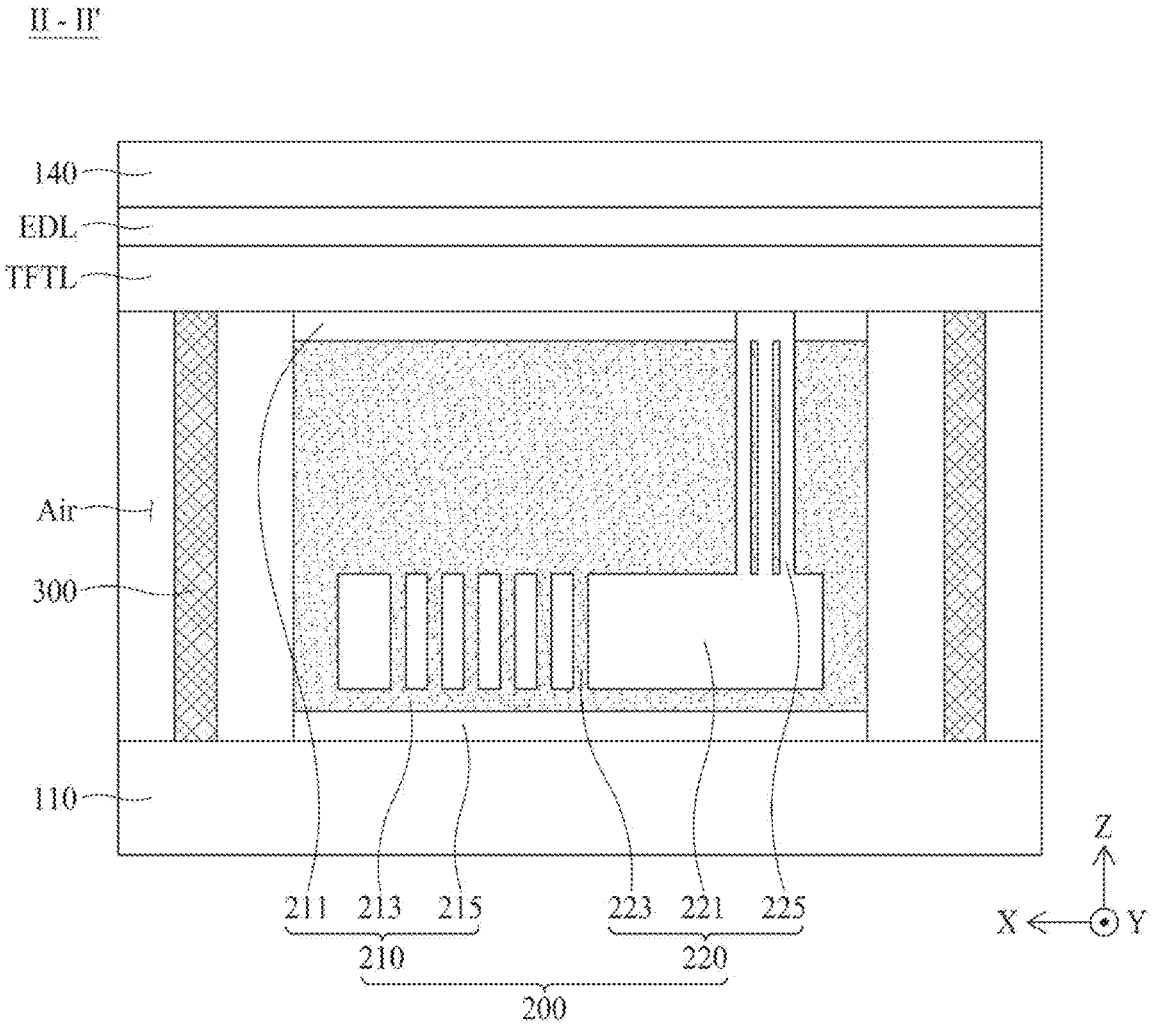
FIG. 9 is a cross-sectional view taken along line II-IF of FIG. 8.

FIG. 8 is a plan view illustrating a display apparatus according to another embodiment of the present disclosure. FIG. 9 is a cross-sectional view taken along line II-IF of FIG. 8.

With reference to the examples of FIGS. 8 and 9, the display apparatus 200 may include a plurality of piezoelectric devices 200, which may be spaced apart from one another. The display apparatus 200 may further include a sound-absorbing member 300 and an adhesive member 400.

The sound-absorbing member 300 may surround the plurality of piezoelectric devices 200, and may be spaced apart from one another, between a first substrate 110 and a TFT layer TFTL. The sound-absorbing member 300 may divide a space in which each of the plurality of piezoelectric devices 200 may be disposed, and thus, may separate sounds generated by the plurality of piezoelectric devices 200. For example, the sound-absorbing member 300 may attenuate or absorb a vibration generated by each piezoelectric device 200, and thus, may block the transfer of a vibration, generated by one piezoelectric device 200, to a region of another piezoelectric device 200 adjacent thereto. Accordingly, the sound-absorbing member 300 may reduce or prevent interference between the sounds generated by the plurality of piezoelectric devices 200 and may enhance a sound characteristic of a sound output through each piezoelectric device 200, thereby enhancing a sound pressure level (SPL). According to an embodiment of the present disclosure, the sound-absorbing member 300 may correspond to an enclosure or a baffle, but the term is not limited thereto.

According to an embodiment of the present disclosure, the sound-absorbing member 300 may include a material having low elasticity, and may absorb a vibration generated by each piezoelectric device 200. For example, the sound-absorbing member 300 may be implemented with a foam pad, and thus, may reduce or prevent the leakage of a vibration generated by each piezoelectric device 200.

The sound-absorbing member 300 may include a plurality of first and second sound-absorbing members 310 and 320, and a protrusion portion 330 that may protrude from at least one side of the second sound-absorbing member 320. According to an embodiment of the present disclosure, the sound-absorbing member 300 may have a mesh structure, which may include a plurality of first sound-absorbing members 310 and a plurality of second sound-absorbing members 320 intersecting the plurality of first sound-absorbing members 310. For example, the plurality of first sound-absorbing members 310 may extend in a first direction X, and may be spaced apart from one another in a second direction Y; and the plurality of second sound-absorbing members 320 may extend in the second direction Y, and may be spaced apart from one another in the first direction X. Therefore, the sound-absorbing member 300 may include a plurality of spaces, which may be provided by intersections of the plurality of first and second sound-absorbing members 310 and 320, and at least one of the plurality of spaces may accommodate at least one piezoelectric device 200.

The protrusion portion 330 may protrude from each of both sides of the second sound-absorbing member 320 to the piezoelectric device 200, and may decrease a sound pressure reduction phenomenon in which a vibration generated from each of the plurality of piezoelectric devices 200 may be reduced. For example, a sound wave generated by the piezoelectric device 200 may spread radially from a center of the piezoelectric device 200, and may travel. The sound wave may be referred to as a "progressive wave." When the progressive wave reaches at one side of the sound-absorbing member 300, the progressive wave may be reflected by the one side of the sound-absorbing member 300 to generate a reflected wave, and the reflected wave may travel in a direction opposite to the progressive wave. When the reflected wave overlaps the progressive wave or is offset by the progressive wave, the sound wave does not travel, thereby generating a standing wave that stands at a certain position. A sound pressure may be reduced by the standing wave. As such, a sound output characteristic of the piezoelectric device 200 may be reduced. Therefore, the sound-absorbing member 300 may include the protrusion portion 330, and thus, may reduce or prevent a sound pressure from being reduced by a standing wave, which may be generated by interference between the reflected wave and the progressive wave. Also, the standing wave, which may cause the reduction in a sound pressure, may often occur at a position at which amplitude of each of the progressive wave and the reflected wave is large. Therefore, the sound-absorbing member 300 may be at a position at which a vibration generated by the piezoelectric device 200 reaches as large an amplitude as possible.

The adhesive member 400 may be between the first substrate 110 and an edge or periphery of the pixel array layer 130, and may attach the first substrate 110 to the pixel array layer 130. Also, the adhesive member 400 may be on the first substrate 110, and may support the edge or periphery of the pixel array layer 130. According to an embodiment of the present disclosure, the adhesive member 400 may be implemented with a double-sided tape, a single-sided tape, an adhesive, and/or a bond, but is not limited thereto. Also, the adhesive member 400 may seal a space between the first substrate 110 and the pixel array layer 130.

A display panel applied to the display apparatus according to an embodiment of the present disclosure may be one of any type of display panel, such as a liquid crystal display panel, an organic light-emitting diode display panel, a quantum dot light-emitting display panel, and an electroluminescent display panel, but is not limited to a specific display panel. For example, the display panel according to the present disclosure may use any display panel that may be vibrated by the piezoelectric device according to the present disclosure to generate a sound. Also, the display apparatus according to an embodiment of the present disclosure may include a display panel including an organic light-emitting layer, a quantum dot light-emitting layer, and a micro light-emitting diode.

Moreover, the piezoelectric device according to an embodiment of the present disclosure may be applied to display apparatuses. The display apparatus according to an embodiment of the present disclosure may be applied to mobile apparatuses, video phones, smart watches, watch phones, wearable apparatuses, foldable apparatuses, rollable apparatuses, bendable apparatuses, flexible apparatuses, curved apparatuses, portable multimedia players (PMPs), personal digital assistants (PDAs), electronic organizers, desktop personal computers (PCs), laptop PCs, netbook computers, workstations, navigation apparatuses, automotive navigation apparatuses, automotive display apparatuses, televisions (TVs), wall papers, signage apparatuses, game machines, lighting apparatuses, notebook computers, monitors, cameras, camcorders, home appliances, etc.

A piezoelectric device and a display apparatus including the same according to an embodiment of the present disclosure will be described below.

According to an embodiment of the present disclosure, a piezoelectric device may include: a first piezoelectric unit including a vibration-generating layer configured to vibrate at an input frequency based on a sound signal corresponding to the input frequency, and a second piezoelectric unit including: an air gap in the first piezoelectric unit, the air gap having a certain volume, and an air path connecting the air gap to an outer portion of the vibration-generating layer, the air gap being configured to output a vibration.

For example, in the piezoelectric device according to an embodiment of the present disclosure, the second piezoelectric unit may be further configured to output a vibration having a frequency differing from the input frequency. For example, in the piezoelectric device according to an embodiment of the present disclosure, the second piezoelectric unit may be further configured to output a vibration having a frequency based on the certain volume of the air gap and a length and a cross-sectional area of the air path. For example, in the piezoelectric device according to an embodiment of the present disclosure, the length of the air path may be longer than a width of the air gap.

For example, in the piezoelectric device according to an embodiment of the present disclosure, when the certain volume of the air gap or a length of the air path increases, the frequency may decrease, and when a cross-sectional area of the air path increases, the frequency may increase. For example, in the piezoelectric device according to an embodiment of the present disclosure, the second piezoelectric unit may include a supporting member in the air gap, the supporting member being configured to support the air gap. For example, in the piezoelectric device according to an embodiment of the present disclosure, the supporting member may be on a first side of the air gap, and the air path may be connected to a second side of the air gap opposite to the first side of the air gap.

For example, in the piezoelectric device according to an embodiment of the present disclosure, the air path may be connected to a center of the air gap, and the supporting member may be in each of both side portions of the air gap. For example, in the piezoelectric device according to an embodiment of the present disclosure, the supporting member may include a same material as a material of the vibration-generating layer. For example, in the piezoelectric device according to an embodiment of the present disclosure, the air gap and the supporting member may be formed in a process of forming the vibration generating layer.

For example, in the piezoelectric device according to an embodiment of the present disclosure, the first piezoelectric unit may include a first electrode configured to receive the sound signal, and a second electrode configured to receive the sound signal, and the vibration-generating layer may be further configured to vibrate based on the sound signal applied to each of the first and second electrodes to output sound. For example, in the piezoelectric device according to an embodiment of the present disclosure, the first electrode may be on a first surface of the vibration-generating layer on which the air path may be disposed, the first electrode does not overlap the air path, and the second electrode may be on a second surface of the vibration-generating layer, opposite to the first surface of the vibration-generating layer. For example, in the piezoelectric device according to an embodiment of the present disclosure, the first piezoelectric unit may be configured to output sound having an audible frequency domain, and the second piezoelectric unit may be configured to output sound having a low sound frequency domain.

According to an embodiment of the present disclosure, a display apparatus may include: a substrate, a piezoelectric device on the substrate, the piezoelectric device being configured to generate a vibration, the piezoelectric device including: a first piezoelectric unit including a vibration-generating layer configured to vibrate at an input frequency based on a sound signal corresponding to the input frequency, and a second piezoelectric unit including: an air gap in the first piezoelectric unit, the air gap having a certain volume, and an air path connecting the air gap to an outer portion of the vibration-generating layer, the air path being configured to output a vibration. The display apparatus may further include a pixel array layer including: a thin-film transistor on the piezoelectric device, and a light-emitting device connected to the thin-film transistor.

For example, in the display apparatus according to an embodiment of the present disclosure, the second piezoelectric unit may be further configured to output a vibration having a frequency based on the certain volume of the air gap and a length and a cross-sectional area of the air path. For example, in the display apparatus according to an embodiment of the present disclosure, the second piezoelectric unit may include a first supporting member in the air gap, the first supporting member being configured to support the air gap.

For example, in the display apparatus according to an embodiment of the present disclosure, the air path of the second piezoelectric unit may be on a surface of the piezoelectric device facing the thin-film transistor. For example, the display apparatus according to an embodiment of the present disclosure may further include an air layer between the air path and the thin film transistor. For example, in the display apparatus according to an embodiment of the present disclosure, the first piezoelectric unit may be configured to output sound having an audible frequency domain, and the second piezoelectric unit may be configured to output a sound having a low sound frequency domain.

For example, in the display apparatus according to an embodiment of the present disclosure, the piezoelectric device may include a plurality of piezoelectric devices spaced apart from one another, and the display apparatus may further include a sound-absorbing member respectively surrounding and between each of the plurality of piezoelectric devices, sound-absorbing member being between the substrate and the thin-film transistor. For example, in the display apparatus according to an embodiment of the present disclosure, the sound-absorbing member may include: a first sound-absorbing member, and a second sound-absorbing member intersecting the first sound-absorbing member. For example, the display apparatus according to an embodiment of the present disclosure may further include a protrusion portion in at least one portion of the second sound-absorbing member.

It will be apparent to those skilled in the art that various modifications and variations may be made in the present disclosure without departing from the technical idea or scope of the disclosure. Thus, it may be intended that embodiments of the present disclosure cover the modifications and variations of the disclosure provided they come within the scope of the appended claims and their equivalents.

What is claimed is:

1. A piezoelectric device, comprising:

a first piezoelectric unit comprising a vibration-generating layer configured to vibrate at an input frequency based on a sound signal corresponding to the input frequency; and a second piezoelectric unit comprising:

an air gap in the first piezoelectric unit, the air gap having a certain volume; and an air path connecting the air gap to an outer portion of the vibration-generating layer, the air path being configured to output a vibration.

2. The piezoelectric device of claim 1, wherein the second piezoelectric unit is further configured to output a vibration having a frequency differing from the input frequency.

3. The piezoelectric device of claim 1, wherein the second piezoelectric unit is further configured to output a vibration having a frequency based on the certain volume of the air gap and a length and a cross-sectional area of the air path.

4. The piezoelectric device of claim 3, wherein:

when the certain volume of the air gap or a length of the air path increases, the frequency decreases; and when a cross-sectional area of the air path increases, the frequency increases.

5. The piezoelectric device of claim 1, wherein the length of the air path is longer than a width of the air gap.

6. The piezoelectric device of claim 1, wherein the second piezoelectric unit comprises a supporting member in the air gap, the supporting member being configured to support the air gap.

7. The piezoelectric device of claim 6, wherein:

the supporting member is on a first side of the air gap; and the air path is connected to a second side of the air gap opposite to the first side of the air gap.

8. The piezoelectric device of claim 6, wherein:

the air path is connected to a center of the air gap; and the supporting member is in each of both side portions of the air gap.

9. The piezoelectric device of claim 6, wherein the first supporting member comprises a same material as a material of the vibration-generating layer.

10. The piezoelectric device of claim 6, wherein the air gap and the supporting member are formed in a process of forming the vibration generating layer.

11. The piezoelectric device of claim 1, wherein:

the first piezoelectric unit comprises:

a first electrode configured to receive the sound signal; and a second electrode configured to receive the sound signal; and the vibration-generating layer is further configured to vibrate based on the sound signal applied to each of the first and second electrodes to output sound.

12. The piezoelectric device of claim 11, wherein:

the first electrode is on a first surface of the vibration-generating layer on which the air path is disposed;

the first electrode does not overlap the air path; and the second electrode is on a second surface of the vibration-generating layer, opposite to the first surface of the vibration-generating layer.

13. The piezoelectric device of claim 1, wherein:

the first piezoelectric unit is configured to output sound having an audible frequency domain; and the second piezoelectric unit is configured to output sound having a low sound frequency domain.

14. A display apparatus, comprising:

a substrate, a piezoelectric device on the substrate, the piezoelectric device being configured to generate a vibration, the piezoelectric device comprising:

a first piezoelectric unit comprising a vibration-generating layer configured to vibrate at an input frequency based on a sound signal corresponding to the input frequency; and a second piezoelectric unit comprising:

an air gap in the first piezoelectric unit, the air gap having a certain volume; and an air path connecting the air gap to an outer portion of the vibration-generating layer, the air path being configured to output a vibration; and a pixel array layer comprising:

a thin-film transistor on the piezoelectric device; and a light-emitting device connected to the thin-film transistor.

15. The display apparatus of claim 14, wherein the second piezoelectric unit is further configured to output a vibration having a frequency based on the certain volume of the air gap and a length and a cross-sectional area of the air path.

16. The display apparatus of claim 14, wherein the second piezoelectric unit comprises a supporting member in the air gap, the supporting member being configured to support the air gap.

17. The display apparatus of claim 14, wherein the air path of the second piezoelectric unit is on a surface of the piezoelectric device facing the thin-film transistor.

18. The display apparatus of claim 17, further comprising an air layer between the air path and the thin-film transistor.

19. The display apparatus of claim 14, wherein:

the first piezoelectric unit is configured to output sound having an audible frequency domain; and the second piezoelectric unit is configured to output a sound having a low sound frequency domain.

20. The display apparatus of claim 14, wherein:

the piezoelectric device comprises a plurality of piezoelectric devices spaced apart from one another; and the display apparatus further comprises a sound-absorbing member respectively surrounding and between each of the plurality of piezoelectric devices, sound-absorbing member being between the substrate and the thin-film transistor.

21. The display apparatus of claim 20, wherein the sound-absorbing member comprises:

a first sound-absorbing member; and a second sound-absorbing member intersecting the first sound-absorbing member.

22. The display apparatus of claim 21, further comprising a protrusion portion in at least one portion of the second sound-absorbing member.

* * * * *